United States Patent [19]

Fox

[11] Patent Number: 4,784,356

[45] Date of Patent: Nov. 15, 1988

[54] VARIABLE PLACEMENT INTERCHANGEABLE LAMP SYSTEM

[75] Inventor: David K. Fox, Wayzata, Minn.

[73] Assignee: Railway Equipment Company, Minneapolis, Minn.

[21] Appl. No.: 17,561

[22] Filed: Feb. 24, 1987

Related U.S. Application Data

[63] Continuation of Ser. No. 830,534, Feb. 18, 1986, Pat. No. 4,666,108.

[51] Int. Cl.[4] ..... B61L 29/04

[52] U.S. Cl. ..... 246/125; 246/261; 246/272; 362/368

[58] Field of Search ..... 246/125, 261, 272, 292, 246/293, 127, 479, 482, 483; 362/396, 368, 430, 152; 404/6; 174/69, 168, 156, 40 CC; 116/63 R, 63 P; 340/114 B, 114 R; 24/459, 460, 545, 555, 561; 403/104; 14/50, 53, 54, 60, 61, 62, 68; 49/93, 124, 141, 334; 248/74.2, 74.3, 74.5; 439/217, 218

[56] References Cited

U.S. PATENT DOCUMENTS

| | | | |
|---|---|---|---|
| 494,390 | 3/1893 | Smith | 49/124 |
| 516,049 | 3/1894 | Harden | 246/482 |
| 545,701 | 9/1895 | Lattig | 246/483 |
| 752,959 | 2/1904 | Currier | 362/368 X |
| 913,974 | 3/1909 | Pettey | 246/126 |
| 1,211,676 | 1/1917 | Coleman | 246/483 |
| 1,818,625 | 8/1931 | Hunter | 248/74.3 |
| 2,386,161 | 10/1945 | Hawes | 403/104 |
| 2,598,196 | 5/1952 | Staley | 246/261 X |
| 2,792,559 | 5/1957 | Maberry | 339/32 R |
| 3,036,146 | 5/1962 | Kamen | 174/69 |
| 3,251,069 | 5/1966 | Clark | 24/545 X |
| 3,538,484 | 11/1970 | Passafiume | 174/69 X |
| 3,964,704 | 6/1976 | Karr | 246/125 |
| 3,994,457 | 11/1976 | Teasel | 246/125 |
| 4,053,760 | 10/1977 | Glazier | 362/396 X |
| 4,067,523 | 1/1978 | Kenny et al. | 246/130 |
| 4,068,966 | 1/1978 | Johnson et al. | 174/47 X |
| 4,186,429 | 1/1980 | Johnston | 362/368 X |
| 4,449,168 | 5/1984 | Ewing | 362/368 X |
| 4,460,811 | 7/1984 | Murr et al. | 200/51.03 |
| 4,523,256 | 6/1985 | Small | 362/418 X |
| 4,666,108 | 5/1987 | Fox | 246/125 |

FOREIGN PATENT DOCUMENTS

| | | | |
|---|---|---|---|
| 2451743 | 5/1976 | Fed. Rep. of Germany | 340/114 B |
| 0715690 | 12/1931 | France | 246/125 |
| 993578 | 11/1951 | France . | |
| 0324007 | 1/1930 | United Kingdom | 439/217 |
| 0701030 | 12/1953 | United Kingdom | 174/156 |

*Primary Examiner*—Robert B. Reeves
*Assistant Examiner*—Scott H. Werny
*Attorney, Agent, or Firm*—Merchant, Gould, Smith, Edell, Welter & Schmidt

[57] ABSTRACT

A variable placement lamp system for use with a supporting member is disclosed which includes a plurality of lamp housings (40) each including a channel for receiving an upper edge of a supporting member. Screw (50) on both sides of the housing (40) are turned until the housing is secured to the support member in a friction fit. Extensible cables (70) with 3-pronged connections connect the lamp circuitry to electrical circuitry to operate the lamps (38) in a predetermined pattern.

20 Claims, 2 Drawing Sheets

FIG. 1
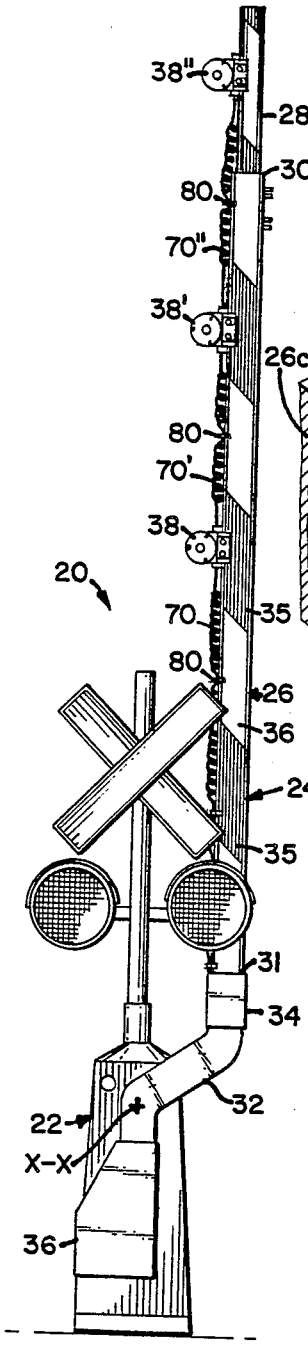
FIG. 2
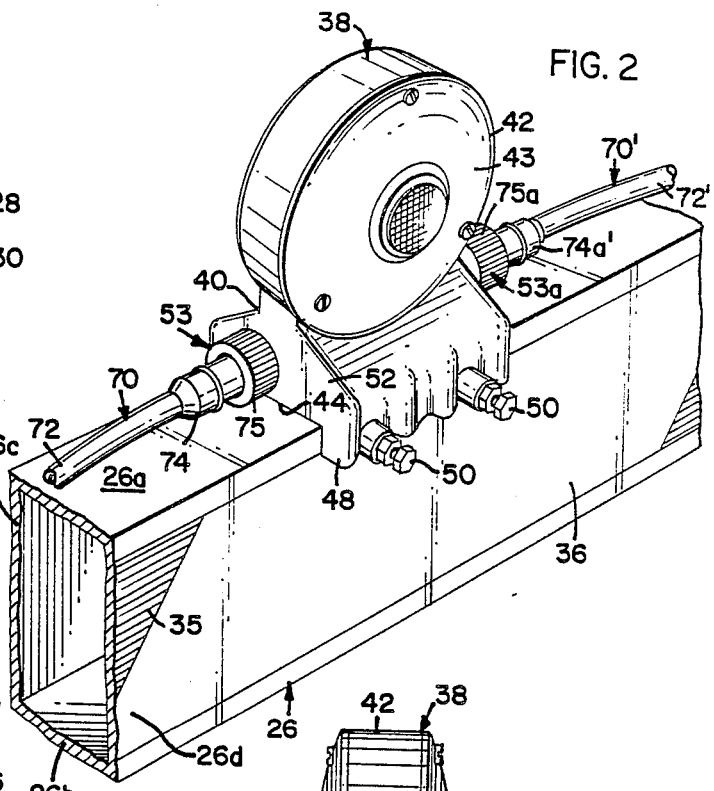
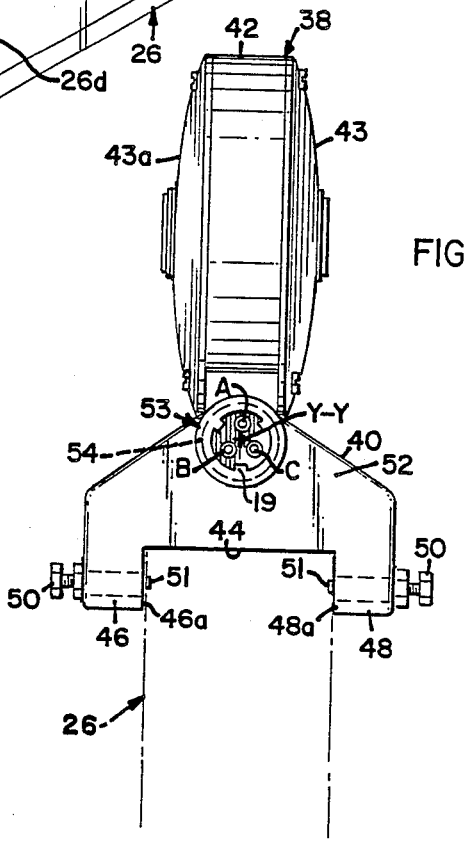
FIG. 3

FIG. 4
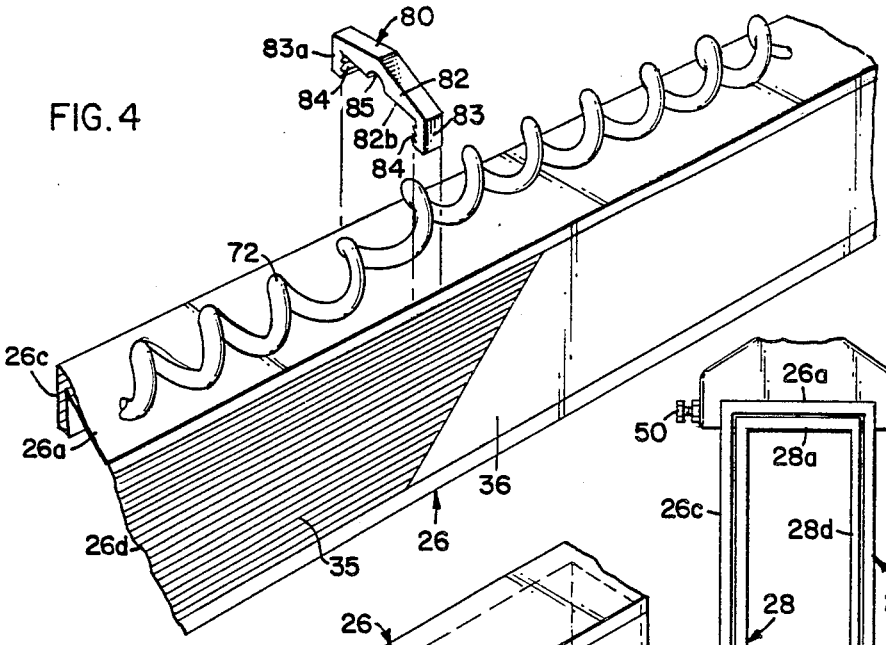
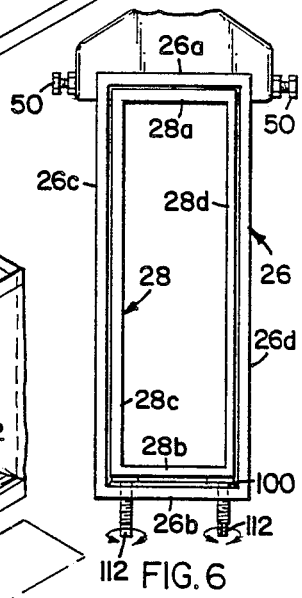
FIG. 6
FIG. 5
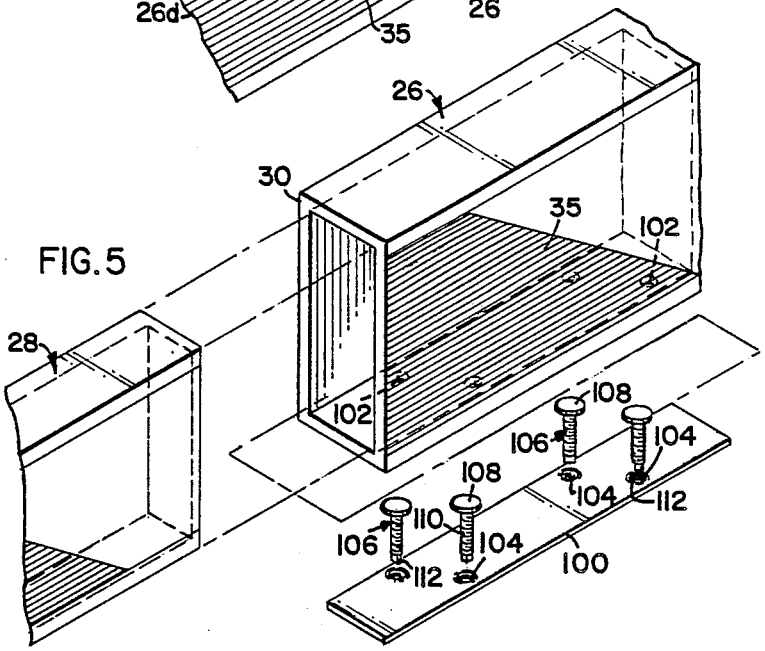
FIG. 8
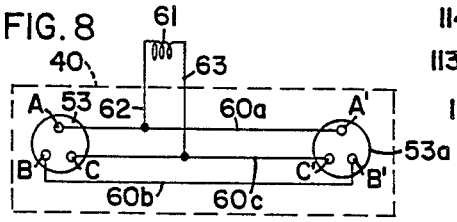
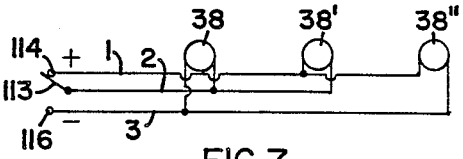
FIG. 7

VARIABLE PLACEMENT INTERCHANGEABLE LAMP SYSTEM

This is a continuation of application Ser. No. 830,534, filed 2/18/86, now U.S. Pat. No. 4,666,108.

BACKGROUND OF THE INVENTION

I. Field of the Invention

This invention pertains to a variable placement interchangeable lamp system and, more particularly, to a variable placement interchangeable lamp system having readily positionable and electrically interconnectable lamps for use on a support member such as a gate crossing arm.

II. Description of the Prior Art

Railroad crossing gates are in wide spread use and are provided with long crossing arms for traffic barriers. The crossing arms are normally upright and are swung to a lowered, horizontal position when an approaching train is detected. The crossing arms of railroad crossing gates are provided with various signal lights which are secured to the crossing arm. Conventionally, three signal lights are used. A first light is disposed at the free end of the crossing arm. The remaining two lights are generally equispaced along the crossing arm. It is conventional that the lights be incorporated into an electrical circuit such that the light at the free end is constantly illuminated when the crossing arm is in its horizontal position. The remaining signal lights are disposed in the electrical circuit such that they are flashing with the two lights alternately flashing off and on.

The environments in which railroad crossing gates are employed are numerous. For example, the crossing gates may be placed adjacent to railroad lines in urban areas where they span streets of widely varying width. Likewise, rural installations also require spans of varying lengths. In addition to these customary settings, railroad crossing arms are found in many industrial settings which also require spans of various lengths.

Due to the indeterminant variety of crossing arm spans which may be required for a crossing gate installation, railroad crossing gates and their set up could not be standardized. For example, the length of the crossing arm could not be determined until the specific site at which the crossing gate was to be installed was known. Once the length of the gate arm was determined, the precise positioning of the signal lights (commonly referred to and hereafter referred to as gate lamps) could then be established. As noted above, the positioning of the gate lamps on the arm is such that the gate lamps are generally equispaced. Since the widths of the traffic lanes are not standardized from application to application, the positioning of the gate lamps on the arm must be done on a case by case basis. As is customary in prior art crossing gates, the gate lamp was secured to a junction box which was mounted on the gate arm either within an interior of the arm or on its exterior. In either event, mounting holes for the junction box would be drilled into the gate arm at each of the desired positions for a gate lamp. With the gate lamps installed, wiring would be run either inside or outside of the gate arm to connect the gate lamps in the appropriate circuitry for two of the lamps to be alternatingly flashing and the end lamp to be constantly illuminated when the arm was in the down position. This would require individual customized electrical work and customized cutting and splicing of wires as well as insuring that the appropriate wire from the circuit led to the appropriate gate lamp.

In light of all the individual manufacturing steps required to fabricate a finished crossing arm for a particular installation, the amount of time and effort required to install a crossing gate is substantial. This is particularly true where much of the installation steps take place in the field. While it would be desirable to standardize the assembly of a crossing arm, the art has not developed such a crossing gate.

OBJECTS AND SUMMARY OF THE PRESENT INVENTION

It is an object of the present invention to provide a variable placement lamp system which is quick and easy to assemble for a variety of support member spans even by an unskilled person.

A further object of the present invention is to provide a variable placement lamp system having lamps which are quickly incorporated into an electrical circuit.

A yet further object of the present invention is to provide a system lamp for a support member which has a position dependent coupling for quickly connecting the lamp to a control circuit.

A further object of the present invention is to provide a variable placement lamp system with standard, interchangeable parts.

According to a preferred embodiment of the present invention, there is provided a variable position lamp arrangement for a support member. A plurality of electrically actuated gate lamps are provided with fasteners for independently fastening each of the lamps to any of a plurality of selected locations on the support member. An elastic cable electrically connects each of the lamps to an electrical source. The lamps include electrical connectors which are position oriented such that when they are attached to the cable they will be in one of a plurality of operating modes dependent upon the position of connection.

BRIEF DESCRIPTION OF THE DRAWINGS

FIG. 1 is a view of a crossing gate having a gate arm according to the present invention;

FIG. 2 is a perspective view of a portion of the gate arm showing a gate lamp secured to the arm;

FIG. 3 is a side view of the gate lamp shown in FIG. 2;

FIG. 4 is a view of the gate arm with an elastic cable showing a cable clamp in exploded view;

FIG. 5 is an exploded view taken in perspective of a portion of the gate arm showing apparatus for fixedly securing a telescoping portion of the arm in a desired position;

FIG. 6 is a side view of a telescoping member of the gate arm fixedly secured in position;

FIG. 7 is a diagrammatic view of the gate lamps electrically interconnected to the relay switch; and FIG. 8 is a diagrammatic view of the electrical interconnection within the gate lamp.

DESCRIPTION OF THE PREFERRED EMBODIMENT

Referring to FIG. 1, a support member such as a railroad grade crossing gate is shown generally at 20. The gate 20 includes a gate stand 22 which is fixed in position along a road side adjacent a railroad line. A crossing arm of the present invention is generally shown at 24. In the embodiment shown, the crossing arm 24 includes a pair of longitudinal arm members including first arm member 26 and second arm member 28. It will be appreciated that in certain applications only one arm member or more than two arm members might be present depending on the crossing arm length required. For purposes of illustration; the preferred embodiment is described as having two arm members. Both of the arm members 26, 28 are hollow and rectangular in cross section with the arm members sized such that second arm member 28 is telescopically received within first arm member 26. A free end 30 of first arm member 26 is open such that second arm member 28 may slide freely to extend the length of arm 24 to any of a plurality of desired lengths. A second end 31 of first arm member 26 is connected to a pivot member 32 by means of any suitable conventional coupling 34. Pivot member 32 is secured to stand 22 for pivotable movement about a generally horizontal axis of rotation X—X. A weighted portion 36 of pivot member 32 on a side of axis X—X opposite that of arm 24 acts as a counter-weight.

Each of arm members 26 and 28 are provided with stationary indicators including alternating patches 35 and 36 of differing colors so that the arm 24 is conspicuous to an individual approaching the gate 20. The arm 24 is pivotable about axis X—X for rotation between a raised position (as shown in FIG. 1) and a lowered position (with the arm 24 extending horizontally away from stand 22) corresponding to open and closed positions, respectively, of the gate 20.

In addition to the alternating patches 35 and 36 the gate arm 24 is provided with electrically actuated signals in the form of gate lamps 38, 38′ and 38″. Each of the gate lamps is identical and a description of one will suffice as a description of the others. With reference to FIG. 2, gate lamp 38 is shown secured to first arm member 26. As can be seen in FIG. 2, arm member 26 is a hollow beam which is rectangular in cross section and includes a flat upper surface 26*a* disposed in parallel spaced relation to a lower plate 26*b* with surfaces 26*a* and 26*b* joined by spaced apart parallel side walls 26*c* and 26*d*. The gate lamp 38 includes a molded, one piece housing portion 40 and a light portion 42. The light portion 42 includes an electrical lamp housed between a pair of transparent diffuser plates such as plate 43 and 43*a* which, conventionally, are colored red.

With reference to FIGS. 2 and 3, the housing 40 has a flat bottom surface 44 having a width equal to the width of upper surface 26*a*. The housing 40 further includes a pair of downwardly extending side portions 46 and 48 which present parallel opposing surfaces 46*a* and 48*a* which are each generally perpendicular to surface 44. The surfaces 46*a*, 48*a* and 44 define a U-shaped channel sized to receive the upper surface 26*a* of arm member 26 slideably against surface 44. A pair of screws 50 are threadedly received through each of side portions 46 and 48 with free ends 51 of the screws 50 positioned to oppose walls 26*c* and 26*d* of arm member 26.

Housing 40 has a pair of parallel end walls 52 which are generally perpendicular to bottom surface 44 and extend upwardly in a direction away from walls 46*a* and 48*a*. Disposed on each of walls 52 is a cable connector 53 and 53*a*, respectively. Connectors 53 and 53*a* are identical and a description of one will suffice as a description of the other. With reference to FIG. 3, connector 53 includes three electrical contact pins labeled A, B and C, respectively, which are housed within a protective shroud 54 integral with the housing 40 and having external threads. Each of pins A, B and C are arranged about an axis Y—Y equidistant from the axis Y—Y and spaced 120° apart. Preferably the protective shroud 54 includes inwardly projecting keys 19 spaced 120 degrees apart.

Housing 40 houses electrical wiring for operation of the lamp which is shown diagrammatically in FIG. 8. In the embodiment shown in FIG. 8, cable connector 53 is shown with its contact pin A, B and C as is cable connector 53*a* with contact pins labeled A′, B′ and C′. A first conductor 60*a* electrically connects pins A and A′. A second conductor 60*b* electrically connects pins B and B′. A third electrical conductor 60*c* electrically connects pins C and C′. In the embodiment shown, the lamp filament 61 has a first lead 62 fixedly and electrically connected to conductor 60*a*. A second lead 63 is fixedly and electrically connected to conductor 60*b*. Accordingly, lamp filament 61 will be illuminated when a potential is placed across pins A and B or A′ and B′. It will be appreciated that varying wiring configurations might be utilized and still be in keeping with the principles of the present invention.

As shown in FIGS. 1, 2 and 4, the crossing arm 24 of the present invention includes extensible cable elements 70, 70′ and 70″ each of which is identical and may be described with reference to cable elements 70 and 70′. The cable elements include an elastically coiled cable 72 extending between a pair of mating connectors 74 and 74*a*. Cable elements 70 include three conductors extending between pin receiving contacts carried in mating connectors 74, 74*a*. The mating connector 74 is urged into the shroud 54 of cable connector 53 with the pins A, B and C being received within aligned pin receiving connectors (not shown) carried by the mating connectors 74 to provide electrical connection between pin A and a first of the conductors carried by cable 70, pin B and a second of the wires carried by cable 70, and pin C and a third of the conductors carried by cable 70. Mating connector 74 is secured within cable connector 53 by means of a cap 75 having internal threads sized to threadedly engage the external threads of shroud 54. The connectors 74 and 74*a* include keyways for cooperating with the keys 19 of the shroud 54 so as to prevent insertion into the shroud 54 if not properly aligned.

It will be appreciated that due to the symmetric relationship of the pins A, B and C, the mating connector 74 can be received within the cable connector 53 in one of three angularly displaced positions. As a result, if the conductors of cable 70 can be referred to as conductors 1, 2 or 3, the connectors 74 and 53 can be connected in one of three positions including a first position with pin A connected to conductor 1, pin B connected to conductor 2 and pin C connected to conductor 3. A second position provides pin A being connected to conductor 2, pin B being connected to conductor 3 and pin C being connected to conductor 1. A third and final position provides pin A being connected to conductor 3, pin B being connected to conductor 1 and pin C being connected to conductor 2.

Referring to FIG. 4, a clamp mechanism 80 is shown for attaching cable element 70 to first arm member 26. The clamp includes a retaining portion 82 sized to extend the width of edge 26*a* and having a retaining surface 82*b* opposing surface 26*a*. A pair of side or securing portions 83 and 83*a* extend downwardly from retaining portion 82 with opposing surfaces of the securing portions 83 and 83*a* presenting jagged teeth 84 extending generally perpendicular to the longitudinal dimensions of portions 83 and 83*a*. Surface 82*b* is provided with a centrally located notch 85 having dimensions sufficient to accommodate the cable 70. Retaining clip 80 retains cable 70 on arm member 26 by forcing clip 80 downwardly onto surface 26*a* with cable 70 received within centrally located notch 85. Teeth 84 are urged onto surfaces 26*c* and 26*d* and provide a friction grip retaining the clip 80 in place. It will be appreciated that second arm member 28 and any additional members might include similar clamps suitably sized for the width of the respective arm member.

As previously described, arm member 28 is telescopically received within arm member 26 and is slideable therein for the composite crossing arm 24 to be extended to any one of a plurality of extended positions. In the embodiment shown, first arm member 26 is a hollow beam of aluminum. Second arm member 28 is a beam of fiberglass material. These materials provide low weight with adequate structural characteristics. It will be appreciated that various materials can be used in keeping with the invention. To hold arm members 26, 28 formed of these materials in a plurality of extended positions, a novel means for securing the second member in a desired extended position is provided.

With reference to FIG. 5 and 6, free end 30 of first member 26 is shown to receive second member 28 therein. As shown, first member 26 is a hollow beam of aluminum and having a rectangular opening sized to receive rectangular cross member 28. The distance between upper and lower surface 28*a* and 28*b* of second member 28 is sized to be slightly less than the distance between upper and lower surfaces 26*a* and 26*b* of first member 26. A stainless steel plate 100 is provided and sized to be received between the lower wall 28*b* of second member 28 and opposing lower wall 26*b* of member 26. Shown best in FIG. 5, the lower wall 26*b* of member 26 at free end 30 is provided with a plurality of threaded holes 102 extending through floor 26*b*. In the embodiment shown, four holes 102 are arranged in the pattern of a parallelogram. However, other patterns could be formed, as will be apparent. Also shown in FIG. 5, steel plate 100 is provided with a plurality of extruded threaded holes 104 formed completely through plate 100. Threaded holes 104 are disposed in a pattern such that steel plate 100 may be disposed upon bottom portion 26*b* with holes 104 aligned with holes 102, the extruded portion of the holes 104 of the steel plate 10 extending generally into the holes 102. A plurality of retaining screws 106 are provided each having a flat head 108 and a threaded shaft 110 extending from the head. In the embodiment shown, the end 112 of the shaft 110 opposite head 108 is a flat plate parallel to the axis of the shaft 110. It will be appreciated that the end 112 might take on varying configurations to enable operation thereon by a hand held tool or the like and still be in keeping with the principles of the present invention. To install the second member 28 within first member 26, steel plate 100 is inserted to abut lower wall 26*b* with holes 104 aligned with holes 102. Screws 106 are threaded through holes 104 and turned such that flat head 108 abuts plate 100 with free end 112 extending through the bottom wall 26*b*. Second member 28 is inserted into first member 26 with screw heads 108 disposed between plate 100 and bottom wall 28*b* in forced transmitting relation as shown in FIG. 6. By grasping free end 112 with any suitable tool (such as a pliers) an installer can turn screws 106 to thread the screw upwardly against wall 28*b* which thereby raises member 28 and urges upper wall 28*a* against upper wall 26*a* in friction fitting abutment.

After second member 28 has been inserted within first member 26 and placed in its desired extended position, second member 28 is secured in its desired position by means of the above-described installation procedure. With second arm 28 and properly extended and fixed in position, gate lamps 38 are installed in their respective positions, notably gate lamp 38″ is installed at the free end of arm 24 and gate lamps 38 and 38′ are placed in their respective positions generally equidistant along arm 24. As can be seen from the structure of the gate lamp 38 as described above, the gate lamps 38, 38′ and 38″ can be quickly installed by simply placing the lamp housing 40 in its desired position with the upper edge 26*a*, 28*a* of the gates 26, 28 received within U-shaped channel defined by surfaces 44, 46*a* and 48*a*. Screws 50 are easily turned with any appropriate tool to urge the free end 51 of the screws in friction fit relation with side walls 26*c* and 26*d*.

With the lamps 38 so installed, the circuitry of the gate mechanism 20 can be completed. With reference to FIG. 7, the desired circuitry for the gate mechanism 20 is diagrammatically shown. Three conductors 1, 2 and 3 are electrically connected to conventional alternating relay switch 113, typically housed in or adjacent the gate stand 22, which alternates between contact with a positive pole 114 and a negative pole 116. A relay switch such as the switch 113 is conventionally used to provide an alternating signal at a railroad grade crossing gate arm. Therefore, the relay switch is only diagramatically illustrated in FIG. 7 as it may be housed at the railroad crossing arm site in numerous ways. In order to have lamp 38″ be continuously illuminated, it is desired to have lamp 38″ be in fixed electrical contact with conductors 1 and 3. It is desired to have lamp 38′ to be a flashing lamp. Accordingly, it is desired to have lamp 38′ electrically connected with conductor 1 and 2. It is also desired to have lamp 38 be a flashing lamp which flashes in phase opposite to that of lamp 38′. Accordingly, it is desired to have lamp 38 be electrically connected to conductors 2 and 3. It will be appreciated that the electrical connections for lamps 38 and 38′ could be reversed and the lamps would still flash alternately.

With the present invention, a person installing the gate arm 24 can rapidly make the necessary electrical connections to insure the desired performance of each of the lamps 38, 38′ and 38″. To this end, the electrical connection of switch 113 is made from the three conductors of cable 70 to the three conductors emanating from switch 113. This is preferably accomplished by using a three pin cable connector such as cable connectors 53. Regardless of the connection used, first mating connector 74*a* of cable 70 is electrically connected to the conductors of the switch 113. This connection can be made with any one of the three possible orientations between the switch conductors and the pin receiving contacts of the cable connector. The second mating connector 74 of the cable 70 is plugged into the first cable connector 53 of lamp 38. With a potential across poles 114, 116, the user looks at lamp 38 to be sure that it is flashing. If it is constantly illuminated, the mating connector 74 is removed and reoriented 120° in either direction and reinserted. So inserted into the cable connector 53, the lamp 38 will be flashing.

With lamp 38, properly connected to the circuit, mating connector 74*a*′ of cable 70′ is inserted into second cable connector 53*a* of lamp 38 in any desired orientation to provide contact-between the pins of the cable connector 53*a* and the pin receiving contacts of mating connector 74*a*′. The other end of the cable 70′ is then inserted into a cable connector 53′ of lamp 38′ and the user checks to see that the lamp 38′ is flashing alternately to the flashing of lamp 38. If not, the user reorients the positioning of the connection until the alternate flashing occurs. In a similar manner, lamp 38″ is electrically connected to lamp 38′ with the user orienting the electrical connection between cable 70″ and lamp 38″ until continuous illumination of the lamp is achieved.

From the foregoing, it can be seen that a crossing arm 24 of the present invention can be installed in an extremely rapid fashion. Arm member 26 is coupled to pivot arm 32 by coupling 34 and arm member 28 is slideably received in arm member 26 until it reaches its desired extended position at which point the fastening apparatus of plate 100 and screws 106 are adjusted to fixedly secure arm member 28 in its desired position. Each of the lamps 38, 38′ and 38″ are rapidly installed in their desired locations and the electrical connection is made between them. The proper electrical connection is made by simply forcing the cable mating connector into the cable connectors in trial and error fashion in one of three positions to make sure the lamps are properly operating in their desired sequence of operation. The gate lamps 38, 38′, 38″ are preferably interchangeable.

The retractable coil nature of each of the cables 72 takes up any spacing requirements between the various lamps 38 such that interchangeable and uniform cables 72 can be used. Moreover, in the preferred embodiment, the cables 72 are uniformly elastic along their length whereby excess cable length is uniformly compensated for over the length of the spans between adjacent gate lamps 38. Additionally, the coiled cables 72 have a size such that they can rest on top of the crossing arm. Clip members 80 hold each of the cables 70 in place.

Moreover, the installer need not worry about selecting a right or left crossing arm, since the present invention does away with the need for a left or right crossing arm, as the appearance of the crossing arm 24 is uniform from either direction.

While the foregoing is a preferred embodiment of the present invention, it will be appreciated there are numerous alternatives which will occur to those skilled in the art which could be used and still fall within the scope of the invention. For example, the three pin cable connectors could be replaced with four-pin connectors having pins A, B and C as well as a centrally located fourth pin D which would be common to all of the lamps. In this alternative embodiment, the fourth pin connector could be connected to a four wire cable having a first wire which will be common to all of the lamps, a second wire which would correspond to constant illumination, a third wire which would correspond to a first flashing illumination and a fourth wire that would correspond to a second flashing illumination which would alternate with the first. As a result of the various modifications of the present invention which could occur to those skilled in the art, it is intended that the scope of the present invention will be limited only to the scope of the claims as are, or may hereafter be, appended hereto.

What is claimed is:

1. A lamp arrangement for a railway crossing arm having a signal relay switch circuitry comprising:

a plurality of electrically actuated lamps disposed in housings separate and distinct from the railway crossing arm;

fastening means for fastening a lamp housing to any of a plurality of selected locations along the length of said railway crossing arm, the fastening means including clamp means for nondestructively clamping the lamp housing onto the railway crossing arm whereby the lamps can be fastened to the railway crossing arm without requiring drilling or other deformation of the support member; and cable means for electrically connecting a lamp fastened to any of said plurality of selected locations on the railway crossing arm to the relay switch circuitry.

2. A lamp system used with a railway crossing arm, comprising:

a housing portion including a means for holding a lamp controllable by electrical circuitry;

fastening means for fastening said housing portion to any of a plurality of selected locations along the length of a separate and distinct railway crossing arm, the fastening means including clamp means for nondestructively clamping the housing portion to the railway crossing arm whereby the housing portion can be attached to the railway crossing arm without drilling or other deformation of the railway crossing arm;

cable receiving means attached to the housing portion for receiving an extensible cable means in a plurality of orientations rotatably offset from each of said orientation providing a different electrical connection between said cable means and said lamp, a first position providing a constant illumination signal, a second position providing an intermittent signal, and a third position providing an intermittent illumination signal reciprocal to the intermittent signal of the second position.

3. A lamp system according to claim 2 further comprising clamp means including a retaining portion and securing portions for securing said cable means to a longitudinal edge of said railway crossing arm, the retaining portion having a retaining surface opposing said edge with said cable means disposed between said edge and said surface, the securing portions depending from said retaining portion and sized to engage opposing surfaces of said support member locking engagement with said cable means disposed between said edge and said surface.

4. A lamp system according to claim 2, wherein the cable means includes a coiled cable having substantially uniform elasticity, the cable means being substantially identical and interchangeable.

5. A lamp system according to claim 2, wherein said fastening means includes said housing portion having opposing surfaces defining a channel for receiving a longitudinal edge of said railway crossing arm at said plurality of selected locations, said fastening means further including securing means for fixably securing said housing portion on said support member at an of said plurality of selected locations.

6. A lamp system according to claim 3 wherein said retaining surface is provided with a notch sized to receive said cable means.

7. A lamp system according to claim 2, wherein said fastening means includes threaded means threadably received in said gate lamp housing and engaging said railway crossing arm.

8. A lamp system according to claim 2, wherein said housing portion has U-shaped base portion slidably receiving a top surfaced of said railway crossing arm with two parallel, spaced-apart side wall portions extending adjacent sides of said railway crossing arm.

9. A lamp system according to claim 2 wherein said cable receiving means includes a shroud member having a plurality of inwardly-projecting keys for receiving a mating connector member of said cable means in a plurality of orientations.

10. A lamp system according to claim 2 wherein said cable receiving means includes three connectors for electrically mating with three connectors of the extensible cable means which are disposed 120 degrees apart.

11. A variable position lamp arrangement for use with signal relay switch circuitry and mountable on a railway crossing arm comprising:

a plurality of housing portions separate and distinct from the railway crossing arm, each including means for holding a lamp controllable by electric circuitry;

a plurality of fastening means for fastening each of aid housing portions to any of a plurality of selected locations along the length of the railway crossing arm, the fastening means including clamp means for nondesctructively clamping the housing portions to the railway crossing arm whereby the housing portions can be fastened to the railway crossing arm without requiring drilling or other deformation of the railway crossing arm;

a plurality of cable receiving means mounted on each of said housing portions for receiving extensible cable means in an of a plurality of orientations, each of said orientations providing a different electrical connection between said cable means and said lamp.

12. A lamp arrangement according to claim 11 wherein said housing portions are substantially identical and interchangeable.

13. A lamp arrangement according to claim 11, wherein said fastening means are substantially identical and interchangeable.

14. A lamp arrangement according to claim 11 wherein said cable receiving means are substantially identical and interchangeable.

15. A lamp arrangement according to claim 11 further comprising a plurality of extensible cable means electrically connecting a lamp held in each of said housing portions to the signal relay switch circuitry of the lamp arrangement, said extensible cable means including means for securing said extensible cable means to said housing portion and means for electrically connecting said extensible cable means to said cable receiving means in a plurality of electrical connection mating configurations.

16. A lamp arrangement according to claim 15 wherein said plurality of extensible cable means includes coiled cable having substantially uniform elasticity, each said cable means being substantially identical and interchangeable.

17. A lamp arrangement according to claim 11 comprising circuitry for said plurality of positions to include first, second, and third positions, the first position providing an electrical signal such that a lamp held in such housing portion is capable of being constantly illuminated; the second position providing an electrical signal such that a lamp held in said housing portion is capable of intermittent illumination; and the third position providing with an electrical signal such that a lamp held in said housing portion is capable of intermittent illumination in a manner reciprocal to the intermittent illumination capable in said second position.

18. A lamp arrangement according to claim 15 wherein said extensible cable means includes a plurality of electrical conductors said electrical conductors having an illuminating signal mode varying with said plurality of interconnection positions such that said lamp held in said housing portion is operated in one of said modes.

19. A lamp arrangement according to claim 11 wherein said extensible cable means are interconnectable to said cable receiving means in any one of three positions.

20. A lamp arrangement according to claim 11 wherein said extensible cable means includes three connectors for electrically mating with three connectors of said cable receiving means which are disposed 120 degrees apart.

* * * * *

UNITED STATES PATENT AND TRADEMARK OFFICE

CERTIFICATE OF CORRECTION

PATENT NO. : 4,784,356

DATED : November 15, 1988

INVENTOR(S) : David K. Fox

It is certified that error appears in the above-identified patent and that said Letters Patent is hereby corrected as shown below:

First page of patent, "[45] Date of Patent: Nov. 15, 1988" should be --[45] Date of Patent: *Nov. 15, 1988--.

On the first page of the patent add the following, --[*] Notice: The portion of the term of this patent subsequent to May 19, 2004, has been disclaimed.--.

On the first page of the patent add the following under "References Cited", --OTHER PUBLICATIONS--.

On the first page of the patent under the newly-added heading "OTHER PUBLICATIONS" add the following, --Gate Arms, three page brochure by the National Electric Gate Company Inc.--.

Line 4 of the Abstract, "Screw" should be --Screws--.

Col. 2, Line 22, "system lamp" should be --lamp system--.

Col. 2, Line 31, delete "gate".

Col. 6, Line 8, delete first occurrence of "and".

Col. 6, Lines 32-33, "diagramatically" should be --diagrammatically--.

Col. 6, Line 39, "conductor" should be --conductors--.

Col. 7, Line 4, "contact-between" should be --contact between--.

Col. 7, Line 52, "four-pin" should be --four pin--.

Col. 8, Line 33, after "each" insert, --other, each--.

UNITED STATES PATENT AND TRADEMARK OFFICE

CERTIFICATE OF CORRECTION

PATENT NO. : 4,784,356

DATED : November 15, 1988

INVENTOR(S) : David K. Fox

It is certified that error appears in the above-identified patent and that said Letters Patent is hereby corrected as shown below:

Col. 8, Line 34, "orientation" should be --orientations--.

Col. 8, Line 62, "an" should be --any--.

Col. 9, Line 5, "surfaced" should be --surface--.

Col. 9, Line 26, "aid" should be --said--.

Col. 9, Line 30, "nondesctructively" should be --nondestructively--.

Col. 9, Line 37, "an" should be --any--.

Signed and Sealed this

Fourth Day of July, 1989

*Attest:*

*Attesting Officer*

DONALD J. QUIGG

*Commissioner of Patents and Trademarks*

US004784356B1

REEXAMINATION CERTIFICATE (2455th)

United States Patent [19] [11] B1 4,784,356

Fox [45] Certificate Issued Jan. 24, 1995

[54] VARIABLE PLACEMENT INTERCHANGEABLE LAMP SYSTEM

[75] Inventor: David K. Fox, Wayzata, Minn.

[73] Assignee: Railway Equipment Company, Minneapolis, Minn.

Reexamination Request:
No. 90/003,198, Sep. 20, 1993

Reexamination Certificate for:

| | |
|---|---|
| Patent No.: | **4,784,356** |
| Issued: | **Nov. 15, 1988** |
| Appl. No.: | **17,561** |
| Filed: | **Feb. 24, 1987** |

Certificate of Correction issued Jul. 4, 1989.

Related U.S. Application Data

[63] Continuation of Ser. No. 830,534, Feb. 18, 1986, Pat. No. 4,666,108.

[51] Int. Cl.[6] ..... B61L 29/00

[52] U.S. Cl. ..... 246/125; 246/261; 246/272; 362/368; 248/228

[58] Field of Search ..... 248/225.31, 228, 231.4, 248/231.6; 362/396, 295

[56] References Cited

U.S. PATENT DOCUMENTS 3,112,016 11/1963 Peterson ..... 248/228

OTHER PUBLICATIONS

Brochure from L&W Industries, Inc., Wheeling, Ill. re ALUMIGLASS 1, One Gate Arm for All Applications, 4 pages, 1982.

*Primary Examiner*—Mark Tuan Le

[57] ABSTRACT

A variable placement lamp system for use with a supporting member is disclosed which includes a plurality of lamp housings (40) each including a channel for receiving an upper edge of a supporting member. Screw (50) on both sides of the housing (40) are turned until the housing is secured to the support member in a friction fit. Extensible cables (70) with 3-pronged connections connect the lamp circuitry to electrical circuitry to operate the lamps (38) in a predetermined pattern.

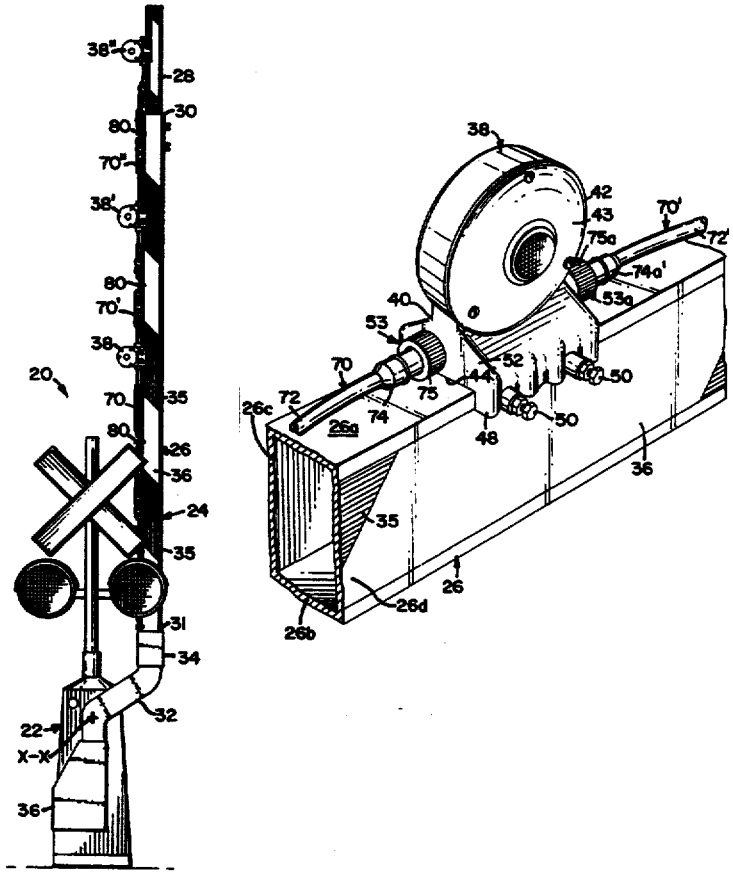

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2–20 is confirmed.

Claim 1 is cancelled.

* * * * *